United States Patent [19]

Garro

[11] Patent Number: 4,531,388

[45] Date of Patent: Jul. 30, 1985

[54] CHANGE CODE SYSTEM IN COMBINATION PADLOCKS

[76] Inventor: Jose I. P. Garro, Gastanaduy, 11-22, Escoriaza (Gipuzcoa), Spain

[21] Appl. No.: 475,453

[22] Filed: Mar. 15, 1983

[30] Foreign Application Priority Data

Jul. 26, 1982 [ES] Spain ..... 514.373

[51] Int. Cl.[3] ..... E05B 37/02

[52] U.S. Cl. ..... 70/25; 70/318

[58] Field of Search ..... 70/25, 312, 315, 316, 70/317, 318

[56] References Cited

U.S. PATENT DOCUMENTS 3,766,758 10/1973 Heine ..... 70/25

4,048,821 9/1977 Bako ..... 70/25

4,341,099 7/1982 Garro ..... 70/25

*Primary Examiner*—Robert L. Wolfe

*Attorney, Agent, or Firm*—Robert E. Ross

[57] ABSTRACT

A combination padlock of the type in which code wheels are mounted on a shaft in the housing and a bushing is associated with each code wheel, the padlock combination being changed by relative rotation between the code wheels and the bushings, in which the shaft is axially fixed in relation to the housing, and the bushings are movable axially on the shaft to release the code wheels to enable the combination to be changed, the bushings being moved by manipulation of the shackle when the shackle is in the open position.

7 Claims, 8 Drawing Figures

Fig. 2
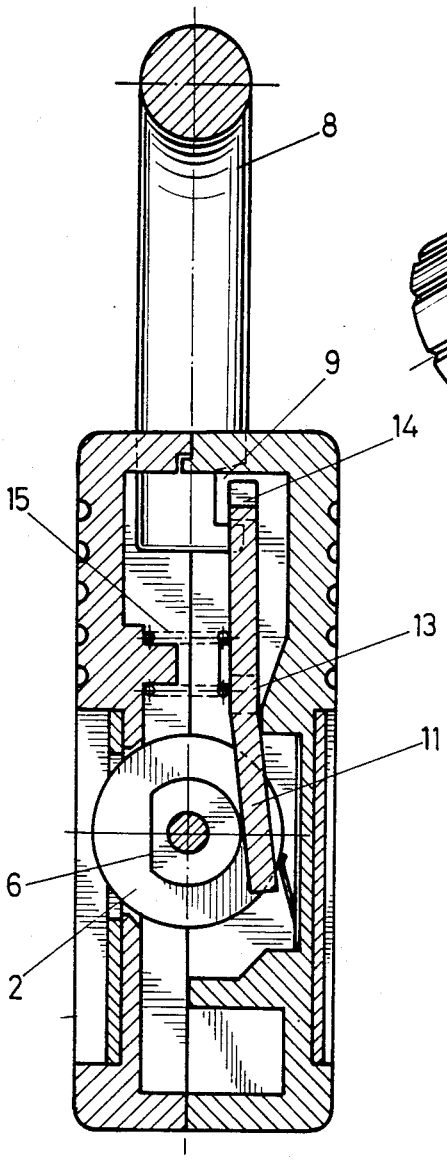
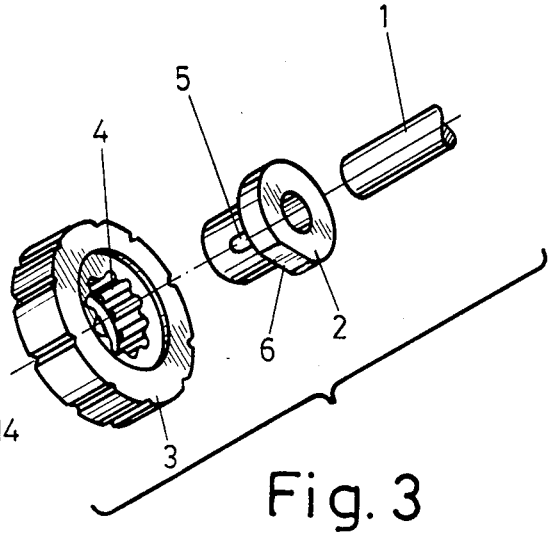
Fig. 3

Fig. 4
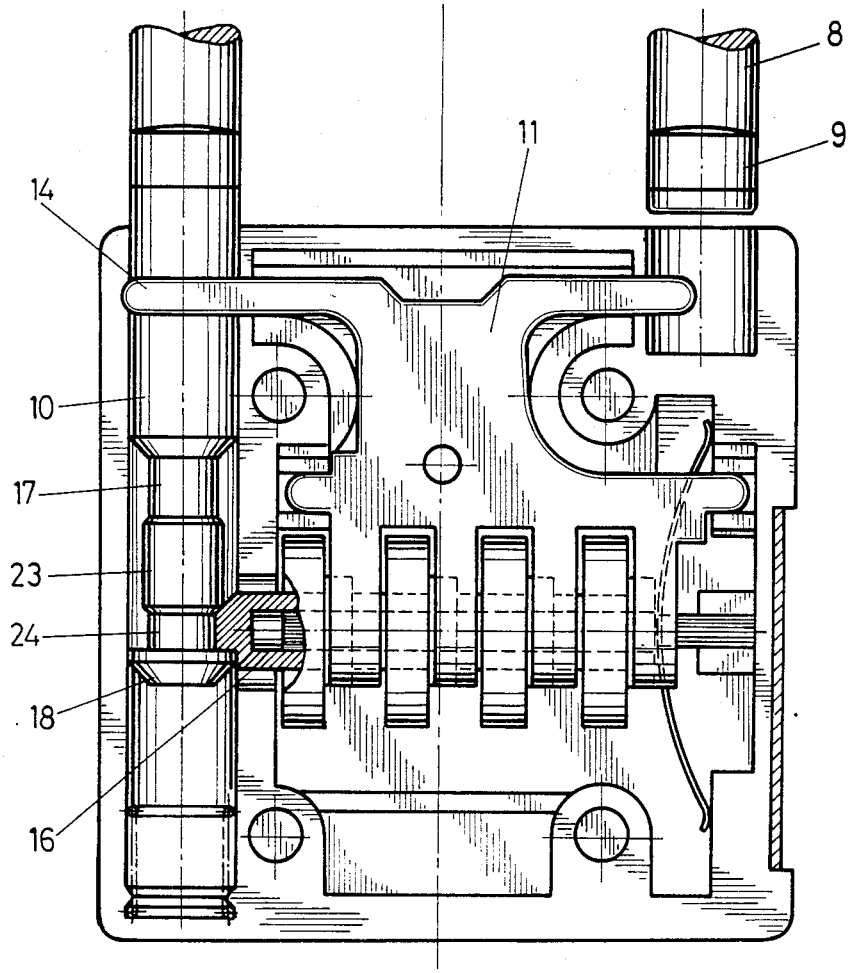
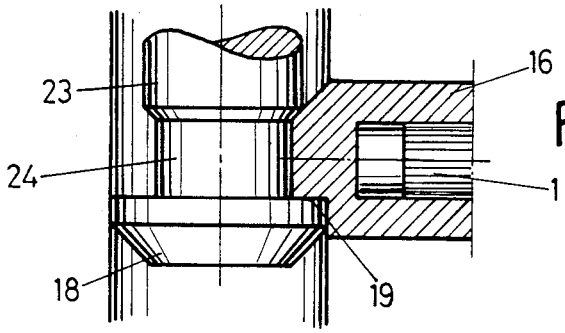
Fig. 5

CHANGE CODE SYSTEM IN COMBINATION PADLOCKS

BACKGROUND OF THE INVENTION

Usually, combination locks consist of a plurality of wheels on the peripheries of which digits are engraved, which wheels are mounted on a single shaft by means of bushings meshing with said wheels by means of reciprocal teeth or a similar solution, which bushings have a flat undercut such that when said undercuts are aligned and the correct, pre-established combination is set, it is possible for a part to be moved and hence the lock or the like to be opened.

This known arrangement of digit-bearing wheels meshing with bushings enables the radial position of the wheels to be changed with respect to the bushings if the wheels and bushings are disengaged, enabling the opening combination to be changed according to the wish of each user.

Specifically, in combination locks, despite the small size of these elements, this disengagement or combination-change mechanism consisted of displacement of the shaft on which the wheels and bushings rode, a relationship existing between these bushings and said shaft which enabled their respective rotation and made them integral in this axial entrainment for disengagement against some elastic means which maintained the operating position of the assembly.

This solution has a number of disadvantages such as the space and the special arrangements the padlock casing must present to permit displacement of the shaft, which negatively affects both the size of the padlock and its manufacture and operation. On the other hand, since axial solidarity is required between the bushings and the shaft, the latter must have some shape or [have] some element establishing this relationship which must be achieved by a mechanical operation implying a further manufacturing step with a consequent increase in the cost of the lock.

SUMMARY OF THE INVENTION

The invention recommended is a new combination-changing system in combination locks. In this system the shaft which supports the digit-bearing wheels and the meshing bushings is a perfectly uniform cylindrical element which occupies an adjusted, static position in the lock case such that when the combination is changed only the meshing bushings are axially displaced because the end bushing, which is longer, is pressed by a sloping element, displacement of which causes perpendicular displacement of the entire set of bushings against a flexible element constituted by a strip curved in the manner of a leaf spring.

The sloping or wedge-shaped element which causes disengagement of the bushings is a tapered surface cut into the long leg of the shackle itself, which penetrates the lock case, specifically in the upper area of the undercut which permits the shackle to open; in this way, when the combination is changed, the first step is to open the lock, the previous combination being known, so that once the shackle is located outside of its closed position and has rotated with respect to this position, it can be pressed such that when the tapered surface contacts the last bushing the set of bushing moves, the digit-bearing wheels being free for the new combination to be set.

This shackle pressure is produced by pressing a spring located on the bottom of the chamber which receives the long leg such that it is necessary for the user, during the combination change, continuously to press the shackle, preventing undesired changes; when this action against the assembly ceases, it returns to the operating position but with a new opening combination.

In summary, it will be seen from the above that the new system described herein presents a series of advantages over prior art, among which are:

greater simplicity of design,
greater solidarity and reliability,
extreme ease of operation,
requires express action by the user to achieve the combination change,
permits a smaller and more compact lock design.

All the above, combined with the other less important characteristics to be seen in the numerical part of the specification makes the recommended invention novel and gives it its own life.

For better understanding of the nature of the present invention the attached figures show (as an illustrative and nonlimitative example) a preferred industrial embodiment, to which figures our description refers.

BRIEF DESCRIPTION OF THE FIGURES OF THE DRAWING

FIG. 2 represents a section of the foregoing figure in profile.

FIG. 3 shows the components of a combination mechanism according to a general, known design, in schematic perspective.

FIG. 4 is a cross-sectional elevation of the open lock.

FIG. 5 is an enlarged detail of the solution showing the lock opening stop.

DESCRIPTION OF THE ILLUSTRATED EMBODIMENT

Figure 1:
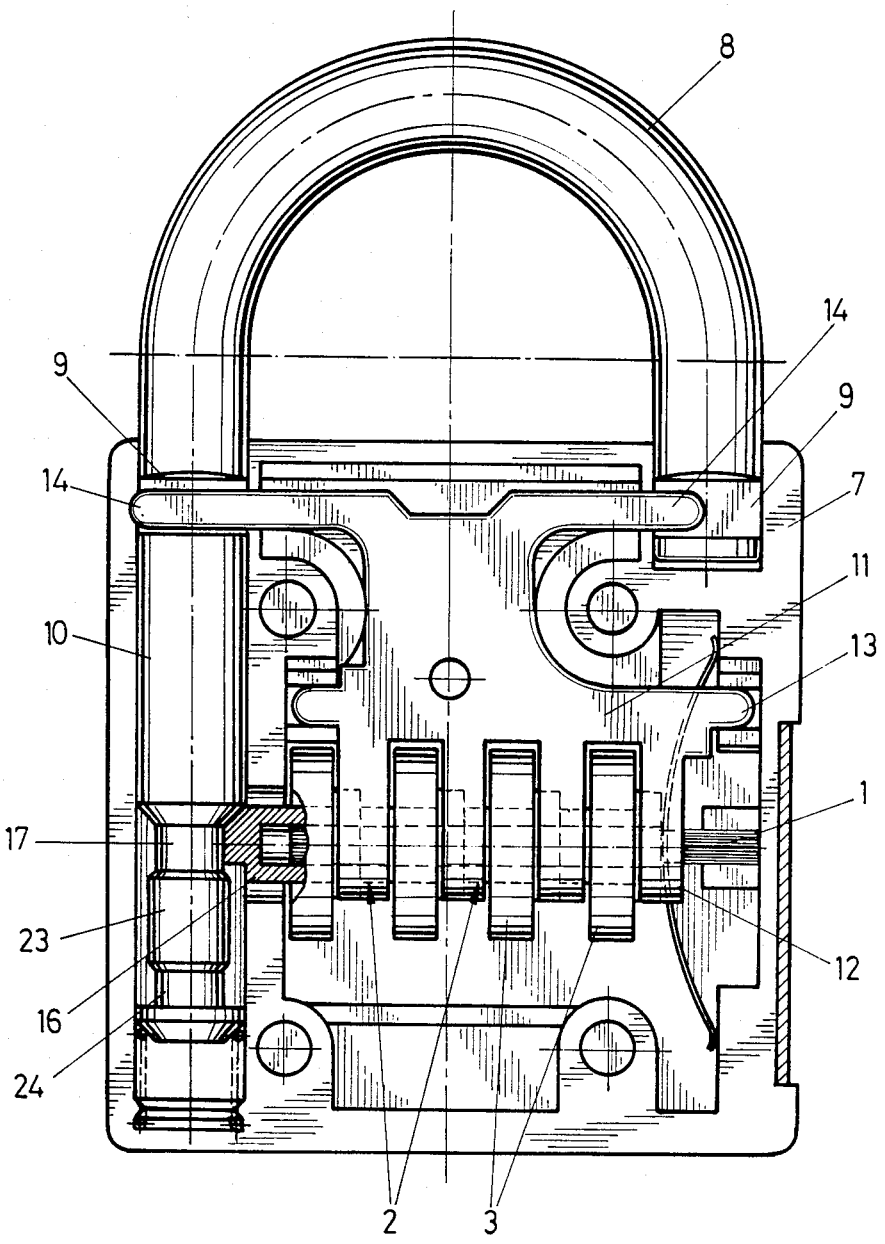
FIG. 1 is an elevation cross section of a lock with the recommended system, which lock is in the closed position.

The subject of this invention is a new combination changing system for combination locks of the type where the combination mechanism consists, according to a known design as shown in FIG. 3, of a shaft (1) supporting a series of digit-bearing wheels (3) which are mounted on meshing bushings (2); said wheels (3) have internal teeth (4) in correspondence with which there exist on bushing (2) projections (5) enabling several relative radial positions to be established between each wheel (3) and its bushing (2). On the other hand, meshing bushings (2) have cut into them flats (6) which, when the preselected combination is set, enable the corresponding opening to occur. Thus, if each bushing (2) is moved axially with respect to its wheel (3), various relative positions of the wheels could be established with respect to said flats (6), and hence various opening combinations could be set.

FIG. 1 shows how this combination system is positioned in the case (7) of a lock in which there is secured a shackle (8) at the top which constitutes the physical element which, together with case (7), performs the locking action.

The present invention is based upon a horizontal shaft (1) which offers the particular feature of being a shaft fixed in its mounting, namely it has no form of axial displacement, and supports the meshing bushings (2) together with their corresponding digit-bearing wheels (3), it being emphasized that the first wheel (3), counting from the long leg (10) of shackle (8), engages an elongated bushing (16), which has characteristics differentiating it from the others such as its greater length, blind orifice and appropriate steps, as we shall see below.

In a closed position, see FIGS. 1 and 2, namely, with the combination which wheels (3) display externally not being the correct one, the situation is such that at least one of flats (6) is misaligned and out of position, see FIG. 3, meaning that corresponding bushing (2) is pushing a rocker lever (11) against a spring (15) locking upper ends or retainers (14) of said rocker lever (11) in notches (9) of shackle (8) so that movement of the latter is impeded.

When the correct combination is set, all the short arms (12) of rocker lever (11) rest on flats (6), thus enabling spring (15) to be extended, which causes rocker lever (11) to pivot on its bearing points (13), releasing retainers (14) from the notches in shackle (8). From this point on, nothing prevents shackle (8) from rising and turning with respect to case (7) with the aim of releasing the secured object.

Shackle (8) is limited in its outward displacement, as can be seen from FIG. 4, and in more detail in FIG. 5, by a stop (18) at the end of its long leg (10), when said stop (18), situated beyond an undercut (24) contacts the long bushing (16), more precisely, flat shoulder (19) on the end of said bushing (16). Because of this, the length of undercut (24) plus that of a central, thicker zone (23) and that of the other, upper undercut (17) establishes the vertical range of travel of shackle (8). Hence, the contact between bushing (16) and undercut (24), see FIGS. 5 and 6, delimits the fixed opening position of the lock, while contact between bushing (16) and undercut (17) defines the fixed locking position, see FIGS. 1 and 7.

Figure 6:
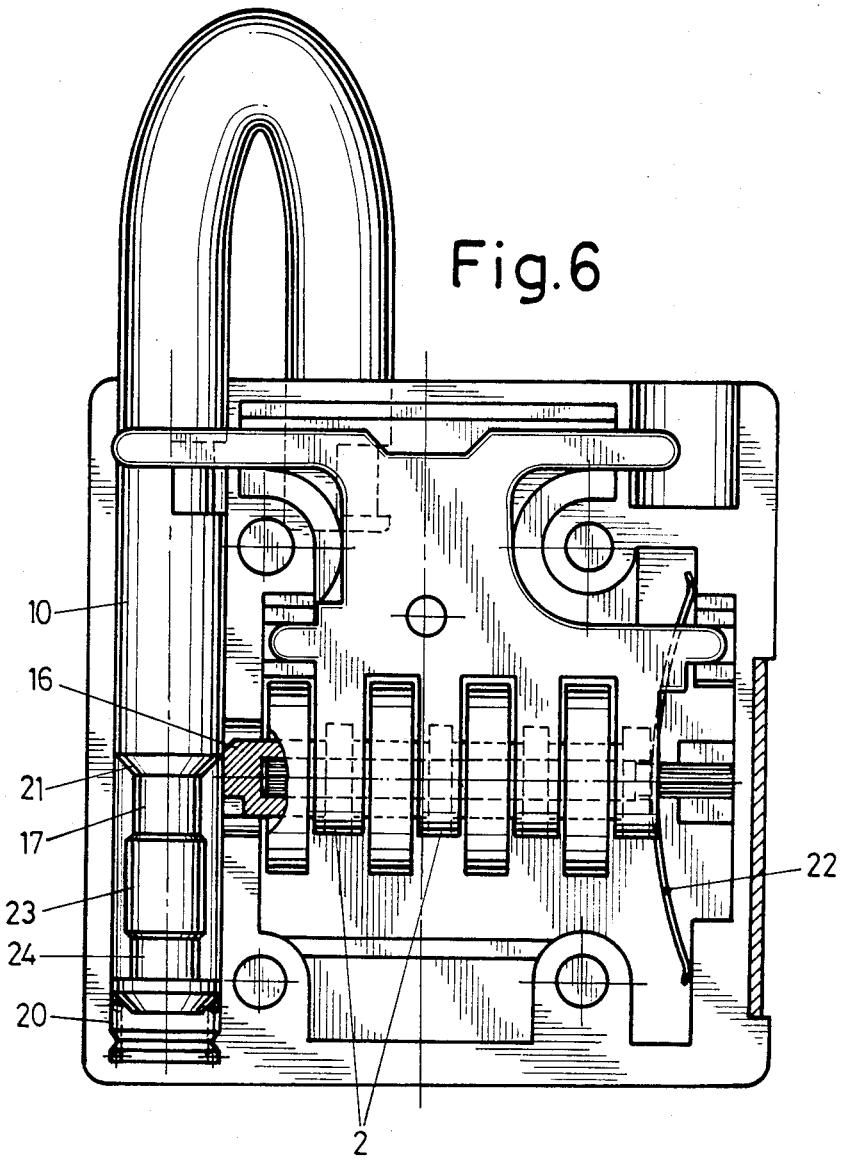
FIG. 6 is a cross-sectional elevation of the lock when the combination is changed.

On the other hand, long bushing (16) constitutes one of the means which permit changing the combination when the lock is open and at the express wish of the user. For this purpose, as shown in FIG. 6, shackle (8), rotated and in the open position, must be pressed toward the inside of case (7) of the lock, against a spring (20) situated at the bottom of the chamber which receives long leg (10).

Figure 7:
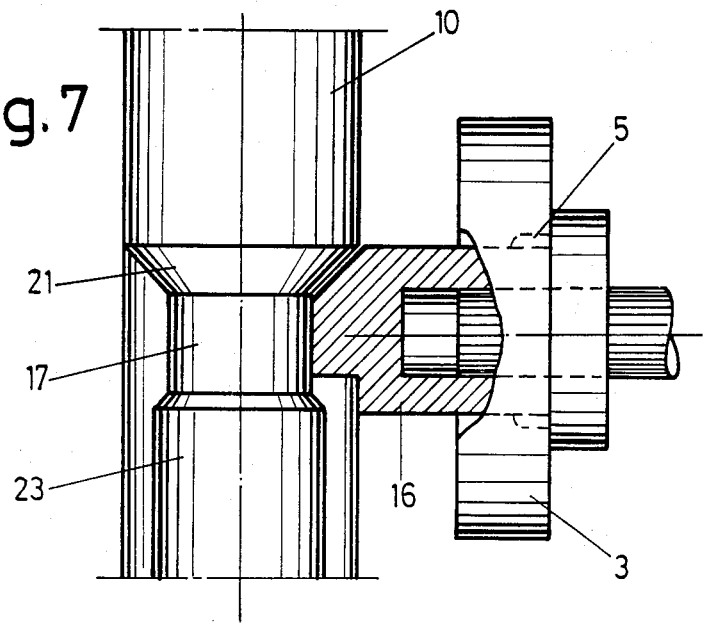
FIGS. 7 and 8 show in detail how, between the combination changing position and the normal position, only bushings (2 and 16) can be moved, the shaft (1) remaining fully static.

Long leg (10) has a bevel (21) at upper undercut (17), which, with the shackle in any rotational position, acts as a ramp which, moving vertically, presses against long bushing (16), directing a thrust against it which makes it slide with respect to shaft (1) and digit-bearing wheel (3), as can be seen in detail in FIG. 7, with shaft (1) remaining perfectly static.

This thrust against long bushing (16) is transmitted via the other bushings (2) since they are all in mutual contact, flexing an elastic strip (22) in the manner of a leaf spring, said strip abutting case (7) and the last bushing, so as simultaneously to disengage all digit-bearing wheels (3) to enable the user to set a new combination.

When the new combination has been set by appropriately moving wheels (3), it is sufficient to release shackle (8), which has been depressed until this time, for long leg (10) to rise under the influence of spring (20), enabling long bushing (16) to move toward undercut (24). This causes wheels (3) to mesh again, the new combination being already set and the lock in the operating position, all once again without shaft (1) having moved at all, as can be seen in detail in FIG. 8.

Figure 8:
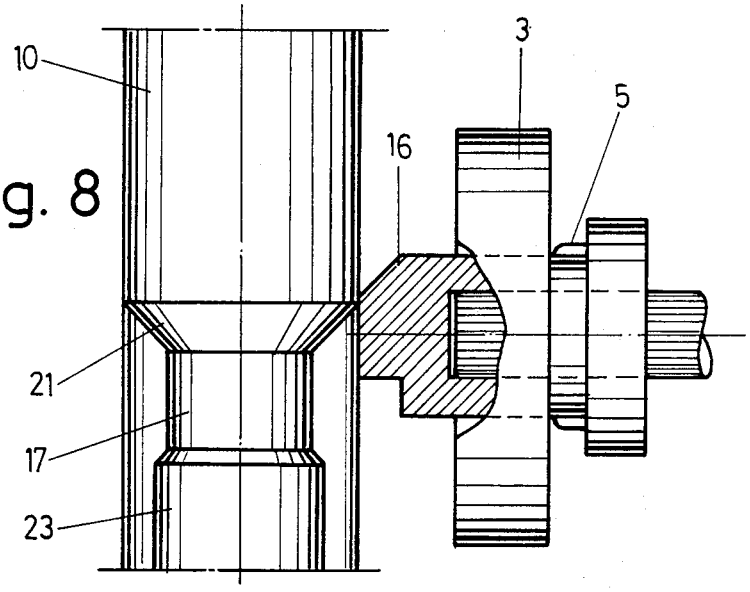

As can be seen, with this new combination-changing system recommended herein, this change is achieved without shaft (1) having to move lengthwise at all, remaining in a static position throughout this changing process, see FIGS. 7 and 8, and being fully rigid; in addition, this change is achieved in any radial position of shackle (8), once the lock has been opened but with the need for continuous actuation on said shackle (8), such that possible involuntary changes of said combination are prevented.

The nature of the present invention having been sufficiently described, as well as its industrial implementation, it need only be added that it is possible to introduce changes of form, material, and arrangement to the invention as a whole and its component parts without departing from the framework of the invention, inasmuch as such alterations do not invalidate its basis.

I claim:

1. A combination padlock of the type having a housing, a shackle, code wheels mounted on a shaft in the housing and a bushing associated with each code wheel on the shaft, the padlock combination being changed by relative rotation between the code wheel and the bushings, said bushings being in end to end relationship, means biasing said bushings toward one end of the shaft and into engagement with the code wheels, said shaft being axially fixed in relation to the housing and the code wheels, and said bushings being movable axially on the shaft to become disengaged from the code wheels by movement on the shaft against the force of the biasing means, and means for causing such movement of the bushings by engagement with the bushing at the end of the shaft opposite the biasing means.

2. A combination padlock as set out in claim 1 in which said means for causing the bushings to move axially on the shaft to the disengaged position includes cam means on a leg of the shackle retained in the housing.

3. A combination padlock as set out in claim 2 in which said cam means is so shaped and positioned that axial movement of the retained shackle leg into the housing beyond the locking position of the shackle causes said bushings to move axially on the shaft.

4. A combination padlock of the type having a housing, a shackle, said shackle having a long leg retained in the housing and a short leg releasable from the housing, a code mechanism comprising an axially fixed shaft extending from a position adjacent to the long shackle leg in the housing to an opposite side of the housing, a series of code wheels on said shaft, and a locking bushing associated with each code wheel on the shaft, said bushings being in end to end relationship and being biased into engagement with said code wheels and toward the shackle leg, the end bushing at the end of the shaft adjacent the leg having an extended portion projecting beyond the end of the shaft, and means for engaging said extended portion to move the bushings axially on the shaft against the biasing force to disengage the bushings from the code wheels.

5. A padlock as set out in claim 4 in which said means comprises an axial cam on the retained shackle leg.

6. A padlock as set out in claim 5 in which the extended portion of the end bushing and said retained leg have cooperating means for preventing removal of the retained leg from the housing.

7. A padlock as set out in claim 4 in which said extended portion encloses the end of the shaft.

* * * * *